US006059219A

United States Patent [19]

Kayser et al.

[11] Patent Number: 6,059,219

[45] Date of Patent: May 9, 2000

[54] WINDING DEVICE AND PROCESS FOR WINDING MATERIAL WEBS

[75] Inventors: Franz Kayser, Geldern; Dirk Cramer, Duisburg, both of Germany

[73] Assignee: Voith Sulzer Finishing GmbH, Krefeld, Germany

[21] Appl. No.: 09/188,209

[22] Filed: Nov. 9, 1998

[30] Foreign Application Priority Data

Nov. 22, 1997 [DE] Germany ..... 197 51 856

[51] Int. Cl.[7] ..... B65H 18/04; B65H 18/06; B65H 18/10; B65H 18/20

[52] U.S. Cl. ..... 242/530.4; 242/541.6; 242/542; 242/547

[58] Field of Search ..... 242/530.4, 541.1, 242/541.4, 541.5, 541.6, 541.7, 547, 542, 542.1, 542.2, 530

[56] References Cited

U.S. PATENT DOCUMENTS

| | | | |
|---|---|---|---|
| 868,761 | 10/1907 | Cohen | 242/530.4 |
| 2,777,644 | 1/1957 | Nicholson | 242/541.1 |
| 3,329,368 | 7/1967 | Mastriani | 242/530 |
| 3,332,636 | 7/1967 | Rockstrom et al. . | |
| 3,383,064 | 5/1968 | Daly et al. . | |
| 3,680,804 | 8/1972 | Aaron et al. | 242/530 |
| 4,988,051 | 1/1991 | Welschiau et al. . | |
| 5,556,053 | 9/1996 | Henseler | 242/541.6 |
| 5,820,063 | 10/1998 | Fissman et al. | 242/530.4 |

FOREIGN PATENT DOCUMENTS

| | | |
|---|---|---|
| 0300220 | 1/1989 | European Pat. Off. . |
| 0791549 | 8/1997 | European Pat. Off. . |
| 7925945 | 12/1979 | Germany . |
| 3243994 | 5/1984 | Germany . |
| 3637426 | 5/1988 | Germany . |
| 4401959 | 7/1994 | Germany . |
| 19606758 | 8/1997 | Germany . |

*Primary Examiner*—John M. Jillions
*Attorney, Agent, or Firm*—Greenblum & Bernstein, P.L.C.

[57] ABSTRACT

Winding device for winding material webs into winding rolls and process for winding material webs. The winding device includes a winding bed composed of at least two carrying rolls, including at least one driven roll, a roll support device having a core retainer and being positioned adjacent to at least one of the two carrying rolls and outside of the winding bed, and a winding roll adapted to be centrally supported by the core retainer. The process includes cutting a plurality of partial webs from a main web, and concurrently winding at least one of the partial webs into a first winding roll in accordance with a carrying roll principle and at least another one of the partial webs into a second winding roll in accordance with the support roll principle.

26 Claims, 3 Drawing Sheets

WINDING DEVICE AND PROCESS FOR WINDING MATERIAL WEBS

CROSS-REFERENCE TO RELATED APPLICATIONS

The present application claims priority under 35 U.S.C. § 119 of German Patent Application No. 197 51 856.7, filed on Nov. 22, 1997, the disclosure of which is expressly incorporated by reference herein in its entirety.

BACKGROUND OF THE INVENTION

1. Field of the Invention

The present invention relates to a winding device for winding material webs into winding rolls. The winding device includes a winding bed that has at least two carrying rolls, at least one of which is driven. Furthermore, the present invention relates to a process for winding material webs cut from a main web into winding rolls.

2. Discussion of Background Information

In one of the last manufacturing steps, a paper web must be wound into a winding roll before it leaves the paper factory to reach an end user, e.g., a printing plant. Since in many cases, the paper webs are manufactured with a greater width than the user requires, the webs must be cut to specified or correct widths prior to packaging. In this manner, a plurality of material webs are produced which have to be wound into a plurality of winding rolls.

A very simple principle for the winding of the winding rolls is the so-called "carrying roll principle." In this procedure, the winding roll to be wound is positioned in a winding bed that includes at least two rolls, of which at least one is driven. The driven roll acts on the circumference of the winding roll to provide the winding. The required nip pressure can be exerted by, e.g., a press roll that presses the winding roll, at least at the beginning of the winding process, into the winding bed. The carrying roll principle is sufficient for many intended uses, and the carrying roll roller utilized in this procedure has a relatively simple design and, therefore, can be produced inexpensively.

In recent times, there has been a trend toward wider rolls. However, with increasing roll width also comes increasing roll weight. The weight of the winding roll has considerable influence on winding tightness because the force due to the weight of the winding roll on the support face determines the nip pressure. Normally, winding tightness should decrease from the inside of the winding roll toward the outside. However, with a winding roll with excessive weight, the course of the winding tightness is exactly the opposite, i.e., tighter on the outside of the roll than inside, which causes problems. In this manner, occasional tube errors occur, e.g., paper layers on the interior of the winding roll shift axially. Occasionally, a rupture of the paper web is also observed on the interior of the winding roll. These and other phenomena lead to damaged or at least almost damaged winding rolls, which should be prevented.

To better control the course of the winding tightness, an alternative procedure, i.e., the so-called "support roll principle," has been developed. Here, the winding roll is secured centrally, i.e., at its winding core, and is rotatably driven. A press roll, which can also be driven, contacts the circumference of the winding roll so as to control the course of the winding tightness. Deflection of the winding roll, which is to be expected with greater roll widths due to the length of the winding roll causing sag in the middle of the winding roll, is compensated for by providing a support roller underneath. However, a support roll roller is much more expensive, which correspondingly increases production costs. This is exacerbated by the fact that, because the winding rolls are secured on their end faces, the individual winding rolls can no longer axially adjoin one another directly, an arrangement that is possible with a carrying roll principle. Thus, winding rolls whose roll cores are arranged on a common imaginary axis must have an axial spacing from one another so that the devices engaging the roll core have enough space available to operate.

SUMMARY OF THE INVENTION

The present invention provides a web winding device that inexpensively permits greater flexibility when winding.

The present invention provides a winding device of the type generally mentioned above that includes a roll support device with a core retainer that may be positioned next to at least one carrying roll outside the winding bed, and a winding roll that can be centrally supported in the core retainer.

As a result, the present invention may be thought of as a compromise between the carrying roll and the support roll arrangements discussed above. The carrying roll, which is relatively simple in terms of structure, can be utilized to wind a winding roll in accordance with the carrying roll principle. For winding rolls in which the carrying roll principle cannot be utilized or is not desired, a winding device may be positioned next to the winding bed formed by the carrying rolls. This winding device may function in accordance with the support roll principle and may be formed by a roll support device with a core retainer or holder. In accordance with this arrangement, the neighboring or adjacent carrying roll can be simultaneously used as a press roll for the support roll device. Therefore, a conventional carrying roll arrangement may be coupled with an auxiliary device in order to realize a combination of the carrying roll and the support roll, i.e., a "combination roll." The combination roll may be a combination of a first winding device, which operates in accordance with the carrying roll principle, that includes a winding bed composed of at least two carrying rolls, one of which is driven, and a second winding device located outside of the winding bed, which operates in accordance with the support roll principle, that includes a roll support device having a core retainer that centrally supports a winding roll core, and, therefore, the a winding roll. A carrying roll may be utilized as a carrying roll of the first winding device and as a press roll of the second winding device. In this regard, it may generally be assumed that a plurality of material webs having different widths may be cut from a wide main web. For the narrower material webs, e.g., between approximately 200 and 3600 mm, preferably between approximately 200 and 2500 mm, and most preferably between approximately 600 and 1500 mm, it may generally be sufficient to use the carrying roll principle. In these instances, the expensive support roll would be superfluous. Moreover, when winding wide material webs, e.g., between approximately 500 and 4000 mm, preferably between approximately 800 and 3600 mm, and most preferably between approximately 1500 and 36000 mm, the same machine may be utilized to wind according to the support roll principle by simply changing the winding position of the winding roll.

Via a selected cutting scheme of the main web, e.g., to alternatingly position narrow material webs between wide material webs, the winding procedure may be performed by arranging the wide material webs to be wound in accordance with the support roll principle, while the narrow material webs are arranged to be wound in accordance with the carrying roll principle.

It is also possible to utilize the winding device for re-rolling. Since there is only a single initial width in this situation, the support roll device can be used, e.g., to achieve a definite course of winding tightness. In this instance, because the roll width is already fixed, a winding station arranged in accordance with the support roll principle may be sufficient.

In the exemplary embodiment, the core retainer may preferably have a central drive. As a result, which is known from conventional support rolls, better control of winding tightness is possible than when the winding roll is only driven by the driven carrying roll.

A distance of the core retainer from the neighboring or adjacent carrying roll may preferably be adjustable. Therefore, the distance between an axis of the winding roll and a circumference (or peripheral surface) of the carrying roll can be adjusted or changed to produce a desired nip pressure as the diameter of the winding roll changes.

The core retainer may preferably be moved in a substantially horizontal direction. In this manner, it is not necessary that the core retainer lift the winding roll, which would require additional work output, or resist a lowering of the increasing weight roll, which likewise requires additional energy.

The axes of the core retainer and the neighboring carrying roll may be advantageously positioned in a horizontal plane. As a result, the carrying roll may be utilized as a press roll independent of the weight of the winding roll. Therefore, winding roll weight does not have to be compensated for, e.g., as would be the case if the corresponding carrying roll were arranged slightly below the winding roll.

The roll support device advantageously may have a relieving device that can be placed against the circumference of the winding roll from beneath. As a result, sagging or deflection of the winding roll, which can occur in known support roll arrangements, may be prevented. In this manner, impermissible web stresses, and web stresses that are primarily not uniform over the axial length of the winding roll, may be substantially avoided.

The relieving device may preferably be formed, e.g., as a roll sling. In this regard, the winding roll may rest on a plurality of rolls or wheels, which extend over a predetermined angular region in the circumferential (peripheral) direction. In accordance with this arrangement, the predetermined angular region may be adjustable. For example, with a greater roll diameter, the winding roll dips deeper into the roll sling so that there are a number of contact points to better distribute the roll weight. In this manner, the nip pressures formed by the relieving device may be controlled relatively well and may be kept within narrow limits.

The roll support device may advantageously include at least one pair of yokes which are arranged substantially parallel to the carrying rolls. In this manner, the widths of the winding rolls can be adjusted to different sizes through axial movement of the yokes.

Further, the core retainers may advantageously be moved on the yokes in a direction substantially perpendicular to the carrying rolls. In so doing, the adjusting potential in the axial direction may be de-coupled from the tracking of the position of the core retainer, which is necessary due to the changing diameter of the winding roll.

The material web may preferably be guided to the winding rolls under the carrying rolls and between a portion of the carrying roll oriented toward the roll support device and the roll support device, i.e., outside of the carrying rolls. In this manner, the course of the material web may be largely kept the same for the winding in accordance with the carrying roll principle and the winding in accordance with the support roll principle. Only after the material web has been guided around the corresponding carrying roll does the course for the material web change for the two winding principles. This may be particularly favorable if, at the same time, at least one winding roll is being wound in accordance with the carrying roll principle and at least one winding roll is being wound in accordance with the support roll principle.

Further, it may be particularly preferable to position a pneumatically operating relieving device in the winding bed. The pneumatically operating relieving device may generate an air cushion used to support the winding roll being wound in accordance with the carrying roll principle. Since the air cushion is only directed at the outside of the winding roll, the air is not wound into the roll, which would be the case if the material web were inserted into the winding bed between the carrying rolls. Therefore, webs, such as paper, that let little or no air escape because the pores of the web have been closed, e.g., by a glazing or a coating process, can be supported on the outer surface of the winding roll by the compressed air.

The present invention provides a process, which while similar in general to the above-mentioned process, can simultaneously wind at least one winding roll in accordance with the carrying roll principle and wind at least one winding roll in accordance with the support roll principle.

In this manner, the process may be performed with a relatively inexpensively formed carrying roll with an auxiliary device provided to permit winding in accordance with the support roll principle. Thus, the cost for the entire device may lie between the cost for a device that operates in accordance with the carrying roll principle and the cost for a device that operates in accordance with the support roll principle, and yet provides more possibilities for winding than known arrangements.

In this regard, it may be particularly preferable to cut the material webs into at least two different widths. In this way, a suitable winding principle, which may be dependent upon the width of the respective webs, may be selected.

The widest winding roll may preferably be wound in accordance with the support roll principle, and the narrowest winding roll may be wound in accordance with the carrying roll principle. In this manner, the desired course for winding tightness may be influenced as a function of the respective winding roll weights.

The present invention is directed to a winding device for winding material webs into winding rolls. The winding device includes a winding bed composed of at least two carrying rolls, including at least one driven roll, a roll support device having a core retainer and being positioned adjacent to at least one of the two carrying rolls and outside of the winding bed, and a winding roll adapted to be centrally supported by the core retainer.

In accordance with another feature of the present invention, the core retainer includes a central drive.

In accordance with another feature of the present invention, an adjustment device is adapted to adjust a distance between the core retainer and the adjacent carrying roll. Further, the adjustment device is adapted to move the core retainer in a substantially horizontal direction. Still further, axes of the core retainer and the adjacent carrying roll are located in a same horizontal plane.

In accordance with still another feature of the present invention, the roll support device includes a relieving device that is positionable underneath a circumference of the winding roll and that is adapted to support the winding roll. Further, the relieving device is composed of a roll sling.

In accordance with a further feature of the present invention, the roll support device includes at least a pair of yokes adapted to be movable in a direction substantially parallel to the adjacent carrying roll. Further, the core retainer is coupled to the yokes and is movable substantially perpendicular to the adjacent carrying roll.

In accordance with a still further feature of the present invention, web guide elements may be positioned to guide the material web under the at least two carrying rolls and to an outside portion of the adjacent carrying roll oriented toward the roll support device. The material web is guided over at least a portion of a peripheral surface of the adjacent carrying roll. Further, a pneumatic relieving device may be located in the winding bed.

The present invention is also directed to a process for winding material webs. The process includes cutting a plurality of partial webs from a main web, and concurrently winding at least one of the partial webs into a first winding roll in accordance with a carrying roll principle and at least another one of the partial webs into a second winding roll in accordance with the support roll principle.

In accordance with another feature of the present invention, the process includes cutting the plurality of partial webs into at least two different widths of partial webs. Further, the process includes winding the partial webs with a widest of the at least two different widths in accordance with the support roll principle. Still further, the widest width is between approximately 500 and 4000 mm, preferably between approximately 800 and 3600 mm, and most preferably between approximately 1500 and 36000 mm.

In accordance with still another feature of the present invention, the process includes winding the partial webs with a narrowest of the at least two different widths in accordance with the carrying roll principle. Further, the narrowest width is between approximately 200 and 3600 mm, preferably between approximately 200 and 2500 mm, and most preferably between approximately 600 and 1500 mm.

In accordance with a further feature of the present invention, the process further includes positioning the second winding roll adjacent to at least one of the carrier rolls, and utilizing the at least one carrier roll as a press roll against the second winding roll. Further, the process includes radially moving the second winding roll relative to the at least one carrier roll.

In accordance with still another feature of the present invention, the process further includes blowing compressed air against an outer circumference of the first winding roll.

In accordance with yet another feature of the present invention, the process further includes forming an air cushion adjacent an outer circumference of the first winding roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
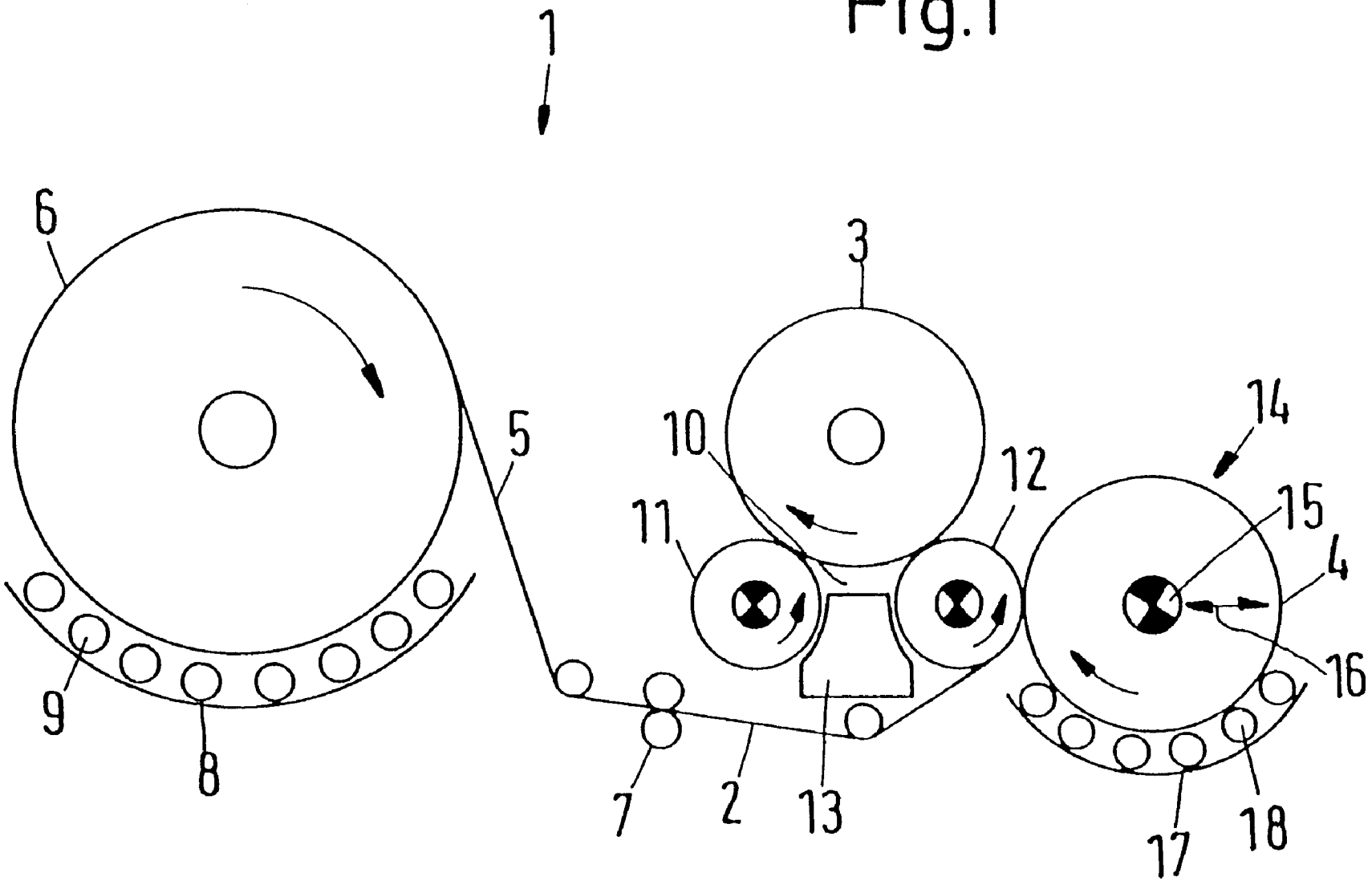
FIG. 1 illustrates a schematic side view of a winding device in accordance with the features of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention may be utilized for winding web rolls. While the exemplary description of the present invention discusses a paper web, the present invention should not be construed as limited to this or any other particular web material. Accordingly, the features of the present invention may be practiced with any material web known to those ordinarily skilled in the art, e.g., plastic, metal, or textile material.

A winding device 1 may be utilized to wind material webs 2 into winding rolls 3 and 4. Material webs 2 may be cut from a main web 5, which may be, e.g., unwound from a jumbo or mother roll 6. A cutting device 7 may be utilized to cut main web 5 in a longitudinal direction, i.e., into a plurality of partial webs. Jumbo roll 6 may be supported by a support device 8 composed of a plurality of rollers 9, which are positioned to support jumbo roll 6 from beneath.

Thus, in accordance with the arrangement of the present invention, winding device 1 includes two different winding possibilities in which winding rolls 3 and 4 may be simultaneously wound in accordance with different winding principles.

A winding bed 10 may be formed by two carrying rolls 11 and 12. Winding roll 3 may be positioned to be wound on winding bed 10. Both of the carrying rolls 11 and 12 may be driven to support a circumference (or peripheral surface) of winding roll 3 and likewise rotatably drive winding roll 3. The rotational directions of winding roll 3 and carrying rolls 11 and 12 are indicated by directional arrows.

A pneumatically operating relieving device 13, e.g., a blow box, may be located in winding bed 10 between carrying rolls 11 and 12. Blow box 13 may produce a compressed air cushion that absorbs part of the weight of winding roll 3.

A roll support device 14 may be arranged, e.g, adjacent to carrying roll 12 and outside winding bed 10. In other words, roll support device 14 may be arranged on a side 8 a vertical plane extending through the rotational axis of carrying roll 12 opposite winding bed 10. Roll support device 14 may include a driven core retainer (or holder) 15 to centrally support winding roll 4. Winding roll 4 may be rotatably driven via driven core retainer 15. In accordance with this arrangement, carrying roll 12 may be utilized as a press roll against winding roll 4. Driven core retainer 15 may be moved horizontally, as indicated by double arrow 16. Further, the rotational axis of driven core retainer 15 and the rotational axis of carrying roll 12 are arranged to be in a same horizontal plane.

As would be apparent to those ordinarily skilled in the art, roll support device 14 may alternatively or additionally be positioned adjacent to carrying roll 11 and outside of winding bed 10.

A relieving device 17, which may be provided to support winding roll 4, may include a large number of rollers 18 arranged to support a portion of the circumferential (peripheral) surface of winding roll 4 from beneath. Relieving device 17 may be in the form of a "roll sling" so that the winding roll may rest on a plurality of rolls or wheels that extend over a predetermined angular region of its circumference. In accordance with this arrangement, the predetermined angular region may be adjustable. For example, with a greater roll diameter, the winding roll dips deeper into the roll sling so that there are a number of contact points to better distribute the roll weight. In this manner, the nip pressures formed by the relieving device may be controlled relatively well and may be kept within narrow limits.

Winding device 1 may be utilized to wind winding rolls in accordance with the carrying roll principle, i.e., winding rolls 3 on winding bed 10, and to wind winding rolls in accordance with the support roll principle, i.e., winding rolls 4 by support roll device 14. The winding rolls to be wound in accordance with the carrying roll principle are preferably formed with webs (or partial webs) having narrower widths, e.g., between approximately, 200 and 3600 mm, preferably between approximately 200 and 2500 mm, and most preferably between approximately 600 and 1500 mm, and, conversely, the winding rolls to be wound in accordance with the support roll principle are preferably formed with webs (or partial webs) having larger widths, i.e., forming winding rolls having longer axial lengths, e.g., between approximately 500 and 4000 mm, preferably between approximately 800 and 3600 mm, and most preferably between approximately 1500 and 3600 mm.

In accordance with the present invention, the cutting arrangement for cutters 7 may be set such that alternatingly arranged wider and narrower partial webs may be cut, e.g., from main web 5. Thus, the narrower partial material webs may be guided to be wound into winding rolls 3 in accordance with the carrying roll principle. Because the narrower partial material webs are located between the wider width partial material webs, sufficient space is provided to wind a plurality of winding rolls 4 in accordance with the support roll principle. That is, according to this arrangement, the core retainers are positionable within the gaps between the wide width partial webs to be coupled with end faces of winding rolls 4.

In contrast, if only a re-rolling procedure is to be performed, then only one winding roll has to be wound and the width of the winding roll is fixed. Accordingly, winding roll 4 can be wound in accordance with the support roll principle, so that it is possible to control the course of winding tightness over the diameter of winding roll 4.

Due to the course of material web 2, which is guided under carrying rolls 11 and 12 and is guided over at least a portion of the peripheral surface of carrying roll 12, simultaneous winding of winding rolls 3 and 4 can be performed in accordance with the carrying roll principle and in accordance with the support roll principle. Further, in accordance with the features of the present invention, winding material webs in accordance with different winding principles presents no difficulties, even if the material webs to be wound are formed from the same main web. The course of material web 2 is kept substantially the same for both winding principles until nearly the end. The path may be slightly longer for the winding of winding rolls 3 because material web 2 must be guided slightly further as it is guided around carrying roll 12.

Moreover, the exemplary embodiment may advantageously include blow box 13 to additionally support the outside of winding roll 3. In accordance with this arrangement, there is no danger that air will be blown between individual winding layers, which could cause problems if material web 2 is intrinsically difficult for air to permeate or is totally impermeable to air.

Figure 2:
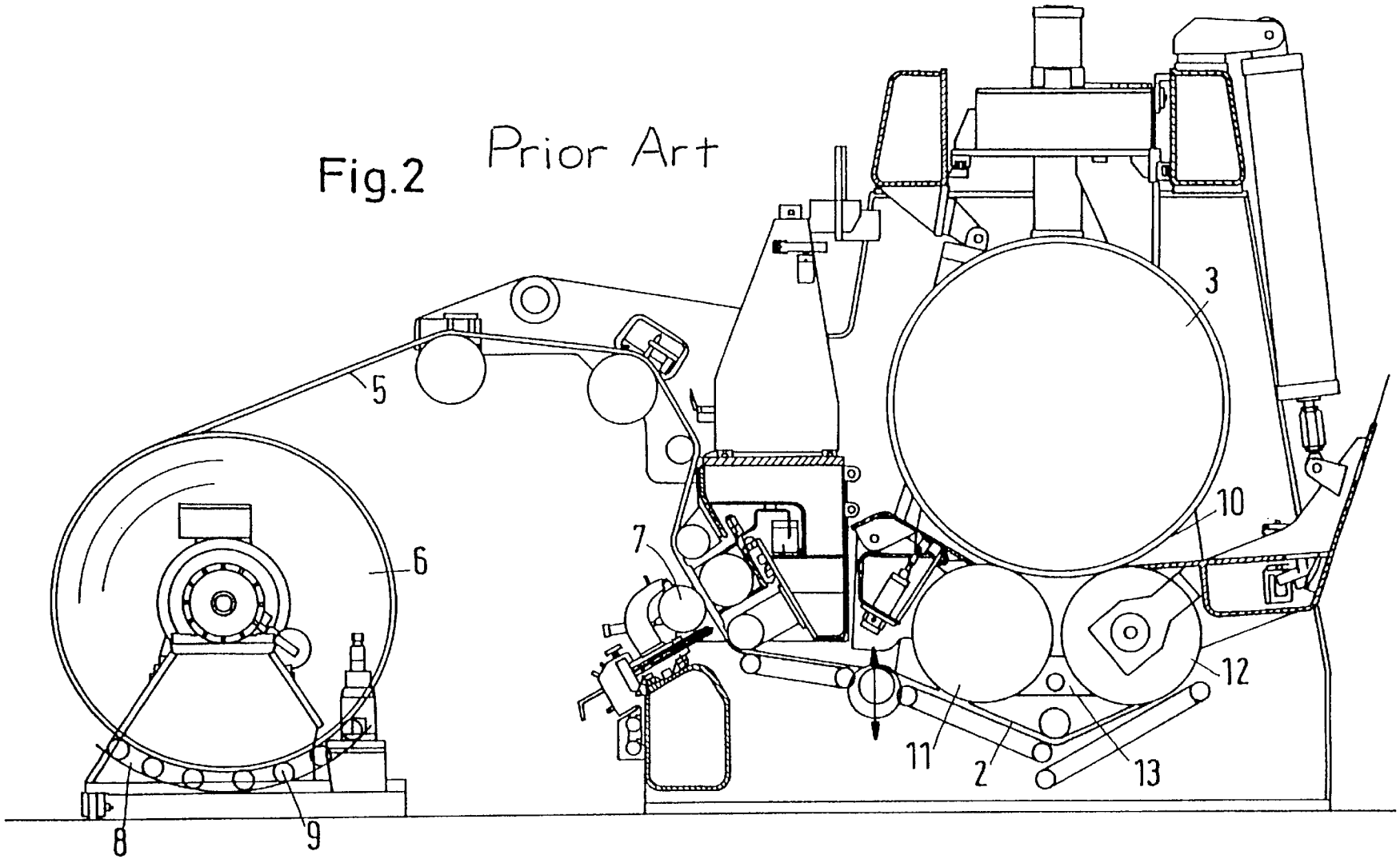
Fig.2 Prior Art
FIG. 2 illustrates a prior art winding device operating in accordance with the carrying roll principle.
Figure 3:
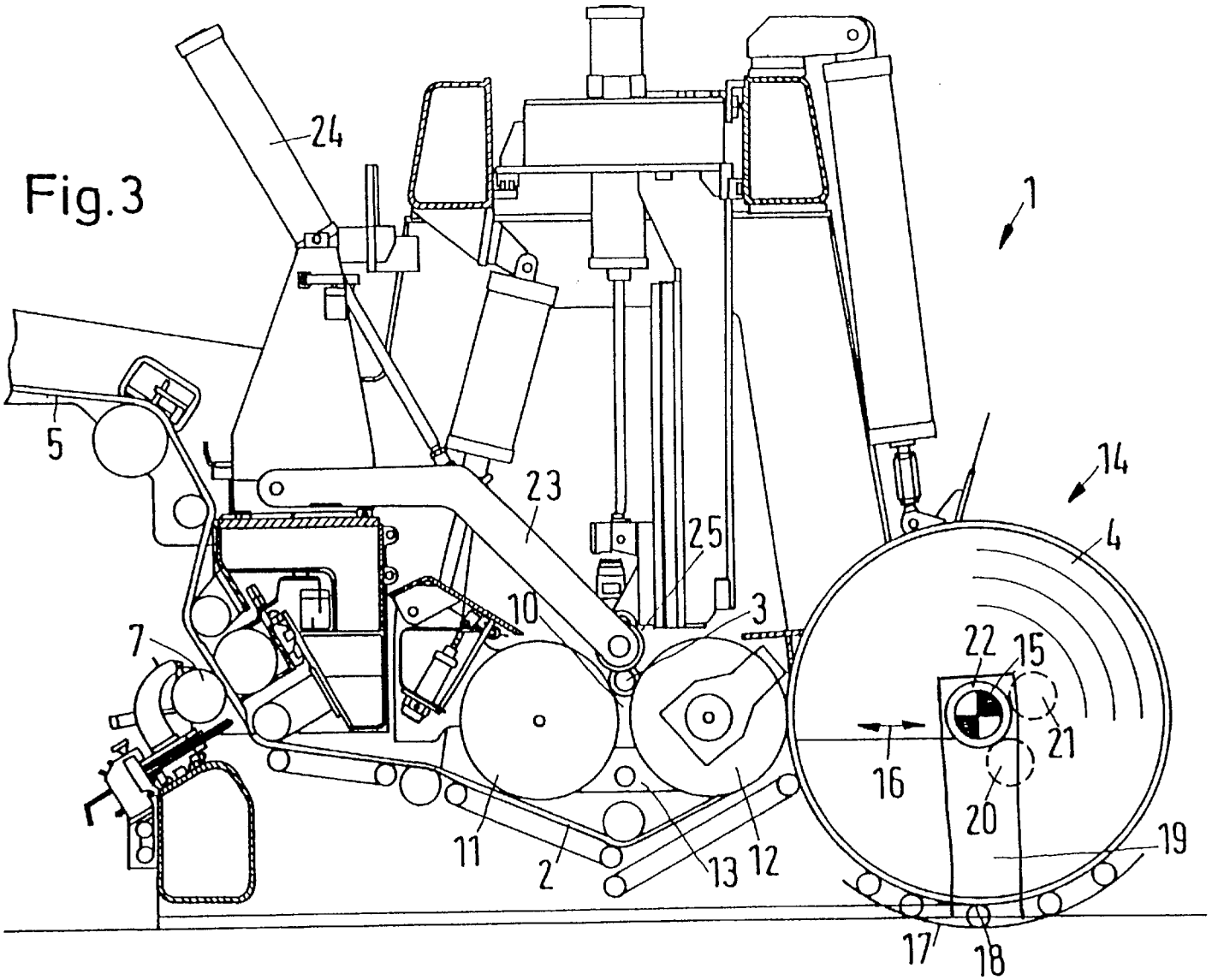
FIG. 3 illustrates a side view of a combined winding device in accordance with the features of the present invention.

FIGS. 2 and 3 illustrate structural details in greater detail. Through a comparison of the prior art depicted in FIG. 2 and the present invention depicted in FIG. 3, it is apparent that relatively few additional measures are necessary to convert a conventional carrying roll winder into winding device 1 in accordance with the features of the present invention.

Elements illustrated in FIGS. 2 and 3 which correspond to elements illustrated in FIG. 1 have been identified with the same reference numerals.

FIG. 2 illustrates a known winding device that operates exclusively in accordance with the carrying roll principle. Winding roll 3 has been illustrated in the nearly completely wound state, and, therefore, has already attained a relatively large diameter. In this regard, it is noted that FIG. 3 is substantially similar to FIG. 2, except that at least one auxiliary device may be provided to the prior art arrangement of FIG. 2 to additionally provide winding in accordance with the support roll principle.

FIG. 3 illustrates winding roll 4, which is positioned adjacent to carrying roll 12 and outside winding bed 10. It is apparent from this exemplary figure that driven core retainer 15 may be arranged on a yoke 19. Yoke 19 may be movable in a direction parallel to carrying roll 12, and a yoke 19 may be provided for each end face of winding roll 4.

Driven core retainer 15 may be coupled to yoke 19 and may, therefore, be movable in a direction indicated by double arrow 16, i.e., transversely (radially) to the carrying roll 12. Therefore, the adjustable axial directional movement of yoke 19 may be de-coupled from the adjustable radial movement in the direction of the double arrow 16 during the winding procedure.

In addition, press rolls 20 and 21 may be positioned between yokes 19 of a particular winding roll. However, since press rolls 20 and 21 are generally only utilized at the beginning of the winding process, i.e., to keep material web 2 pressed against core 22 with a required pressure, press rolls 20 and 21 are illustrated with dashed lines and are disposed "on the interior" of winding roll 4. As is known in the art, press rolls 20 and 21 may be pivoted away from winding roll 4 as the winding process continues. In this instance, the course of winding tightness is only determined by carrying roll 12 functioning as a press roll against winding roll 4, which is coupled to driven core retainer 15.

In order to wind winding roll 3 with the requisite pressure at the beginning of the winding process, i.e., to produce a high degree of winding tightness, a lever 23 may be operated or controlled by a cylinder 24. Press roll 25, located at a front end of lever 23 and against winding roll 3 at the beginning of the winding process, may press winding roll 3 into winding bed 10, i.e., against carrying rolls 11 and 12.

A number of operational modes are now possible with winding device 1. For example, winding device 1 may be utilized to exclusively wind a winding roll in accordance with the support roll principle when re-rolling. With paper and other material webs, it may also be possible to exclusively wind a winding roll in accordance with the carrying roll principle.

However, a particular advantage may be realized by winding winding rolls 3 in accordance with the carrying roll principle simultaneously with the winding of winding rolls 4 in accordance with the support roll principle. As discussed above, the simultaneous winding is facilitated by arranging narrow winding rolls 3 to be positioned between wide winding rolls 4. That is, the narrow and, therefore, light winding rolls 3 may be wound in accordance with the carrying roll principle while the wide and, therefore, heavy winding rolls 4 are wound in accordance with the support roll principle.

Since the arrangement of winding rolls into separate and substantially parallel winding groups result in an axial gaps being formed between narrow winding rolls 3 in winding bed 10 and between wide winding rolls 4 adjacent to carrying roll 12, the driven core retainers coupled to wide winding rolls 4 may be arranged within the axial gaps formed by winding rolls 3 between winding rolls 4.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A winding device for winding material webs into winding rolls comprising:

a winding bed composed of at least two carrying rolls, the at least two carrying rolls comprising at least one driven roll, wherein the winding bed is adapted to wind a first winding roll;

a roll support device having a core retainer and adapted to wind a second winding roll;

the roll support device being positioned adjacent to at least one of the two carrying rolls to wind the second winding roll outside of the winding bed and in contact with one of the at least two carrying rolls; and the second winding roll being adapted to be centrally supported by the core retainer.

2. The device according to claim 1, the core retainer comprising a central drive.

3. The device according to claim 1, further comprising an adustment device adapted to adjust a distance between the core retainer and the adjacent carrying roll.

4. The device according to claim 3, the adjustment device being adapted to move the core retainer in a substantially horizontal direction.

5. The device according to claim 4, wherein axes of the core retainer and the adjacent carrying roll are located in a same horizontal plane.

6. The device according to claim 1, the roll support device comprising a relieving device that is positionable underneath a circumference of the winding roll and that is adapted to support the winding roll.

7. The device according to claim 6, the relieving device being composed of a roll sling.

8. The device according to claim 1, the roll support device comprising at least a pair of yokes adapted to be movable in a direction substantially parallel to the adjacent carrying roll.

9. The device according to claim 8, the core retainer being coupled to the yokes and being movable substantially perpendicular to the adjacent carrying roll.

10. The device according to claim 1, further comprising web guide elements, the web guide elements positioned to guide the material web under the at least two carrying rolls and to an outside portion of the adjacent carrying roll oriented toward the roll support device, wherein the material web is guided over at least a portion of a peripheral surface of the adjacent carrying roll.

11. The device according to claim 10, further comprising a pneumatic relieving device located in the winding bed.

12. A process for winding material webs comprising:

cutting a plurality of partial webs from a main web; and concurrently winding at least one of the partial webs into a first winding roll in a winding bed formed by at least two carrying rolls and at least another one of the partial webs into a second winding roll in a winding device that includes a support roll having a core retainer, wherein the second winding roll is wound against one of the at least two carrying rolls and outside of the winding bed.

13. The process according to claim 12, further comprising:

cutting the plurality of partial webs into at least two different widths of partial webs.

14. The process according to claim 13, further comprising:

winding the partial webs with a widest of the at least two different widths as the second winding roll.

15. The process according to claim 14, wherein the widest width is between approximately 500 and 4000 mm.

16. The process according to claim 14, wherein the widest width is between approximately 800 and 3600 mm.

17. The process according to claim 14, wherein the widest width is between approximately 1500 and 36000 mm.

18. The process according to claim 13, further comprising:

winding the partial webs with a narrowest of the at least two different widths as the first winding roll.

19. The process according to claim 14, wherein the narrowest width is between approximately 200 and 3600 mm.

20. The process according to claim 14, wherein the narrowest width is between approximately 200 and 2500 mm.

21. The process according to claim 14, wherein the narrowest width is between approximately 600 and 1500 mm.

22. The process according to claim 12, further comprising:

utilizing the one carrier roll as a press roll against the second winding roll.

23. The process according to claim 12, further comprising:

radially moving the second winding roll relative to the one carrier roll.

24. The process according to claim 12, further comprising:

blowing compressed air against an outer circumference of the first winding roll.

25. The process according to claim 12, further comprising:

forming an air cushion adjacent an outer circumference of the first winding roll.

26. An apparatus for selective winding a material web, which has been longitudinally cut into a plurality of partial webs, into a plurality of wound rolls, the apparatus comprising:

a first winding device comprising at least two carrier rolls arranged to form a winding bed, wherein at least one of the carrier rolls is a driven roll and whereby a first winding roll is formed within the winding bed; and a second winding device, located adjacent to the first winding device and outside of the winding bed, comprising a roll support device having a core receiver adapted to centrally hold and drive a second winding roll formed adjacent one of the at least two carrier rolls and outside of the winding bed, wherein the second winding device is adapted to press the second winding roll against the one of the at least two carrier rolls.

* * * * *